United States Patent [19]

Kawada

[11] 4,151,986

[45] May 1, 1979

[54] SAMPLING APPARATUS OF PRINTED PAPERS FROM CONVEYOR LINE THEREOF

[75] Inventor: Tomoshi Kawada, Kawasaki, Japan

[73] Assignee: Kabushiki Kaisha Tokyo Kikai Seisakusho, Tokyo, Japan

[21] Appl. No.: 817,433

[22] Filed: Jul. 20, 1977

[30] Foreign Application Priority Data

Mar. 31, 1977 [JP] Japan ..... 52-036460

[51] Int. Cl.[2] ..... B65H 29/60

[52] U.S. Cl. ..... 271/64; 93/93 R; 198/367; 198/442

[58] Field of Search ..... 271/64; 198/366, 367, 198/442, 436, 437; 93/93 R, 93 K, 93 C, 93 DP

[56] References Cited

U.S. PATENT DOCUMENTS 4,004,694 1/1977 Stogren ..... 271/64

*Primary Examiner*—Bruce H. Stoner, Jr.

[57] ABSTRACT

An upright conveyor belt is made to run only at one side of the row of papers. A section plate is operatively arranged to be inserted into the line of the conveyor, for retaining subsequent papers within the row. A blade is adapted to be moved across the line of the conveyor so as to sample a predetermined number of papers out of the row. A feeler for detecting the leading end of the earliest subsequent paper is provided at a position spaced downwardly from the location of the blade insertion. The blade can be timely actuated by the signal from a limit switch provided at the base of the feeler. A fork is provided at the side of the row of the papers so as to interrupt the line to eject the subsequent papers along the fork.

6 Claims, 19 Drawing Figures

SAMPLING APPARATUS OF PRINTED PAPERS FROM CONVEYOR LINE THEREOF

BACKGROUND OF THE INVENTION

The present invention relates to an automatic sampling apparatus adapted to pick up a small number, e.g. two, sheets from a conveyor line of the sheets which may be printed papers such as newspapers arrayed in a regular pitch of overlapping and conveyed, through the conveyor line, to a counter stacker, after being folded.

In printing and forwarding of newspapers, the newspapers printed and folded by a rotary press are conveyed to a counter stacker, through a conveyor line. During this convey, it is necessary to sample a small number, e.g. two, sheets from the conveyor line kept in order, for the purpose of checking or confirming the state of folding and shearing.

Conventionally, this sampling has been made manually, by a highly skilled operator, who picks up the sampling sheet quickly out from the moving conveyor line by his fingers.

Therefore, the line of convey of the newspapers is likely to be disordered, resulting in a failure of the equipments disposed at downstream side of the sampling location, for example, the clogging of a counter-stacker by the papers.

This is the reason why an apparatus capable of performing the sampling without causing the line of convey to be disordered has been longed for.

It is therefore an object of the invention to provide an automatic apparatus for picking small, e.g. two, number of printed papers from its line of convey kept in order, for the purpose of sampling, without disturbing the line of convey of the papers, without disturbing the line at leading and trailing sides of the papers picked out.

It is another object of the invention to provide an accurate and highly reliable automatic sampling apparatus having controlling means which ensure correct positioning of a sampling blade, by preserving a correct timing of insertion of the blade into the line of convey irrespective of change in the speed of convey.

It is still another object of the invention to provide an automatic sampling apparatus in which a reasonable arrangement is made by employing an automatic ejecting means for ejecting wasted papers caused by suspension of paper feeding, commencement of the printing, failure of a carrier or by an emergency stop due to a tearing of the paper, the ejecting means being conveniently incorporated in a discharge port for the sampling apparatus.

SUMMARY OF THE INVENTION

Briefly, according to the invention, there is provided an automatic sampling apparatus having a conveyor line having an upright carrier section in which a conveyor belt is made to run only at one side of the row of the papers in which the overlapping ends of the papers appear in the leading side, i.e., in the direction of the movement of the conveyor line, while no conveyor belt is provided at the other side of the row. A roll is provided at the upper end portion of the upright section for free up and downward movement, so as to provide an optional increase and decrease of the number of sample, as well as to preserve the preceding papers within the row. The apparatus further comprises, as means for preserving the subsequent papers within the row, a section plate adapted to be inserted into the line of convey from the side at which the conveyor belt is provided.

A blade is adapted to be moved across the line of convey, at a position of the latter above the inserted section plate, so as to bring a predetermined number of printed papers out of the line.

A feeler adapted for actuating a limit switch for detecting the leading end of the earliest subsequent paper is provided at a position spaced downwardly from the location of the blade insertion.

The distance obtained by subtracting a half pitch from the distance between the feeler and the position of blade insertion is determined as a set distance.

As a push button switch is pushed and closed, a counting of pulses the number of which corresponding to the set distance is commenced, simultaneously with the advancement of the section plate.

As pulses of a number corresponding to the operation time of the blade has been counted, the counting is temporarily stopped. The counting of the remainder of the pulses is commenced on the basis of an inputting of a detection signal from the limit switch, and the order for moving the blade ahead is issued when the set number of pulses have been counted.

A fork may be provided at the side of the row of papers at which the conveyor belt is provided for insertion into the line of convey, so as to interrupt the line to eject the subsequent papers along the fork.

DESCRIPTION OF THE PREFERRED EMBODIMENT

Hereinafter, a practical embodiment of the invention will be described in detail for an understanding of the construction and advantageous effect of the invention.

Figure 1:
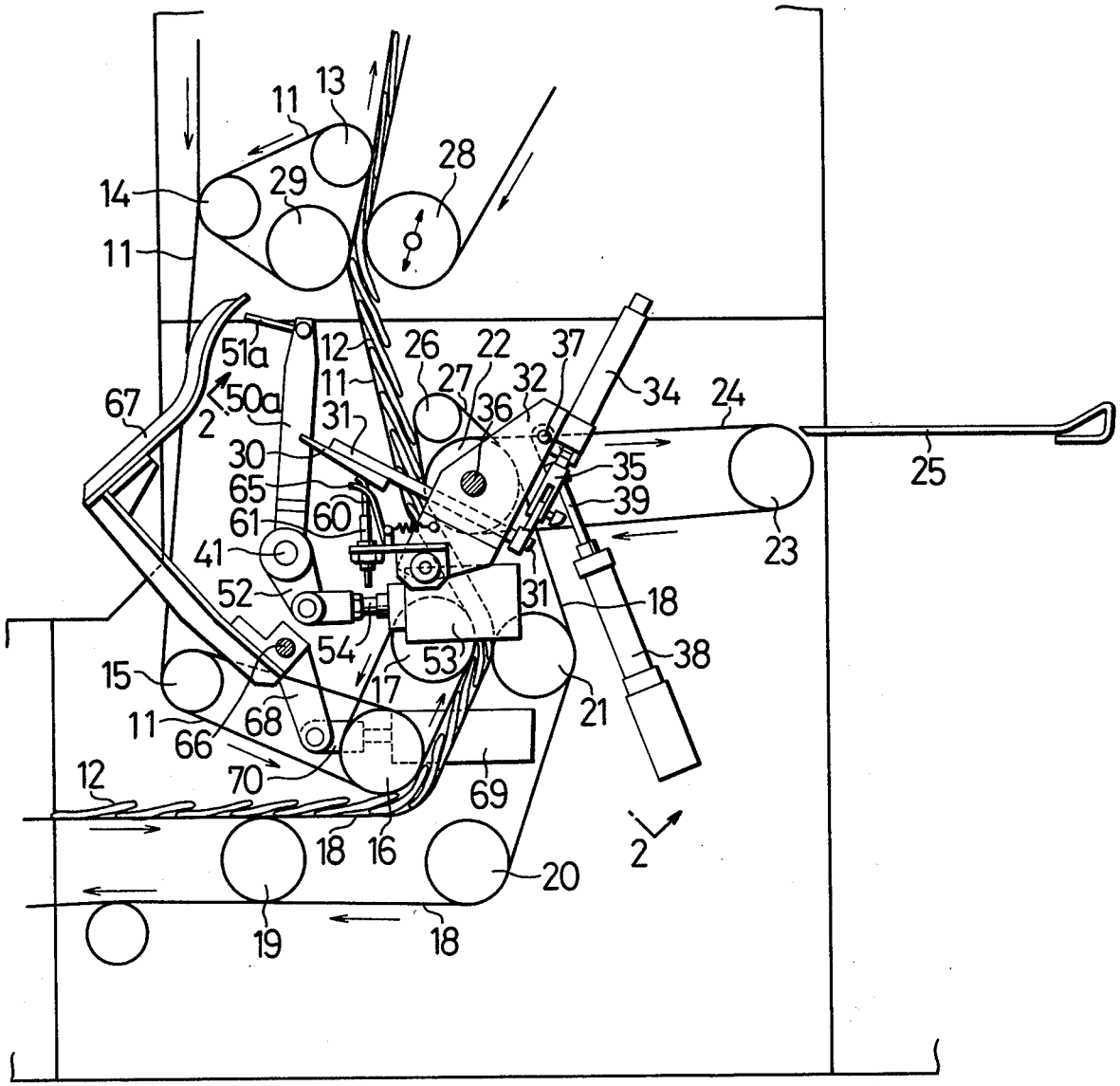
FIG. 1 is a side elevational view of the whole apparatus in accordance with the present invention.

Referring at first to FIG. 1, an automatic sampling apparatus of the invention is so arranged that its operation points may be concentrated to an upright carrier section of a newspaper conveyor line which is almost vertical but slightly inclined upwardly and leftwardly.

A wire belt 11 consisting of a spring is provided to run along only one side of the conveyor line at which the overlapping end of the successive papers appear in the leading side, i.e., in the direction of the movement of the conveyor line (left-hand side as viewed in FIG. 1). The belt solely guides the row 12 of the newspaper to move upwardly. No conveyor belt is provided at the other side, i.e., right-hand side, of the row 12 of the newspaper.

As shown in FIG. 1, the whole arrangement of the conveyor line for the row 12 of the newspaper, the conveyor belt 11 is constituted by an endless belt which is adapted to move upwardly through the upright carrier section. Thus, the endless belt 11 goes in order round an idle roller 13, a drive roller 14, an idle roller 15, a drive roller 16 and then an idle roller 17, in the counter-clockwise direction, so as to provide a guide for one side of the row 12 of the newspapers to move upwardly.

An endless wire belt 18 made of a spring is stretched over four rollers, i.e., a driving roller 19, and idle rollers 20 through 22, to move clockwisely, so as to provide a guide for the other side of the row 12 of the newspapers.

The newspapers which have been folded in a folding section of a rotary press to have a length of 275 mm are put one on the other at a constant pitch of overlapping of 42 mm in average to form the row 12, and are made to pass along a horizontal path shown in the lower section of FIG. 1.

Subsequently, the newspapers are successively clamped between the pair of conveyors 11 and 18, and move upwardly through the upright section of the carrier toward a counterstacker.

The idle roller 22 is provided at the lowermost portion of the upright section. Another idle roller 23 is provided laterally of the roller 22, spaced therefrom in the right-hand side direction. Between the rollers 22 and 23, stretched is a conveyor belt 24 for ejecting newspapers. The arrangement is such that the belt 24 is moved as the idle roller 22 rotates clockwisely, so as to convey the sampled newspapers to a shelf 25.

An arm not shown is provided on the shaft of the idle roller 22, and carries at its end a small auxiliary roller 26 rotatably. An endless belt 27 is stretched between the rollers 22 and 26. The roller 26 is moved to an upright position as shown in FIG. 1, so as to prevent the falling down of the newspapers, when the number of pages of the newspaper is not so large as to provide a sufficient stiffness. The auxiliary roller 26 is swung rightward to an inactive position, when the number of the pages is large to provide a large thickness of the newspapers, i.e., the sufficient stiffness to ensure a self-supporting nature of the newspapers.

At least one of the pair of rollers 28,29 provided at the uppermost position of the carrier upright section is adapted to be moved up and down (roller 28 is supposed exemplarily to be movable in the illustrated embodiment), so as to allow an optional increase of the number of the picked up newspapers for sampling, within the range of 2 to 4. The arrangement is such that the upper, i.e., leading end of a preceding newspaper has reached and clamped between the rollers 28,29, so that the newspaper may not be pushed out by an impact when the subsequent one is extracted for the purpose of sampling.

Similar consideration must be made also to the newspapers subsequent to the picked up ones, so that they may not be folded by an impact during the operation of a picking up blade, and so as to prevent disturbance in the subsequent row of the newspapers such as disordering of the overlapping pitch. For ensuring the subsequent newspapers to be retained in the row correctly, thereby to prevent above explained inconveniences, there is provided a mechanism including a section plate which will be detailed hereinunder.

Figure 2:
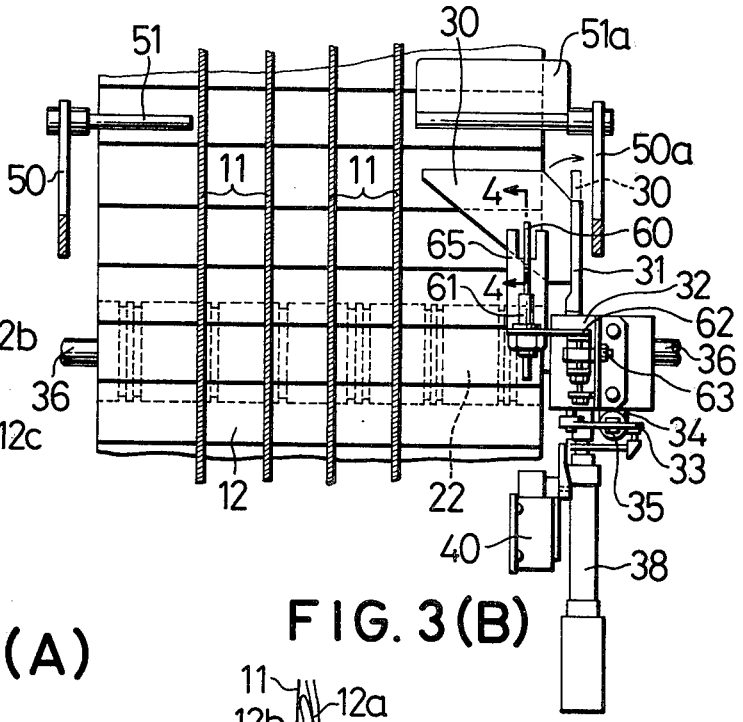
FIG. 2 is a sectional view taken along the line 2—2 of FIG. 1, FIGS. 3A and 3B are side elevational views for explaining mainly means for ensuring the stay of the subsequent paper in the row.
Figure 3A:
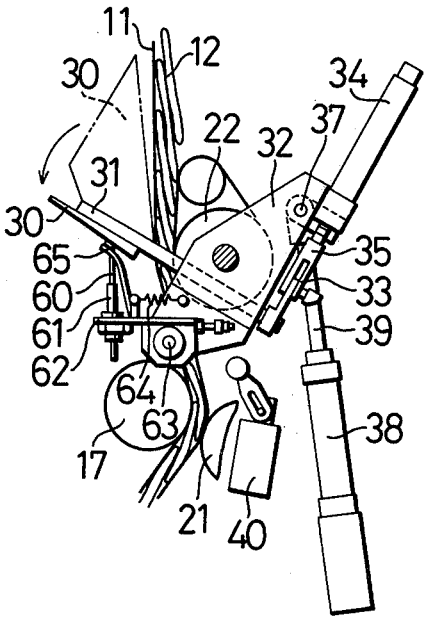
Figure 3B:
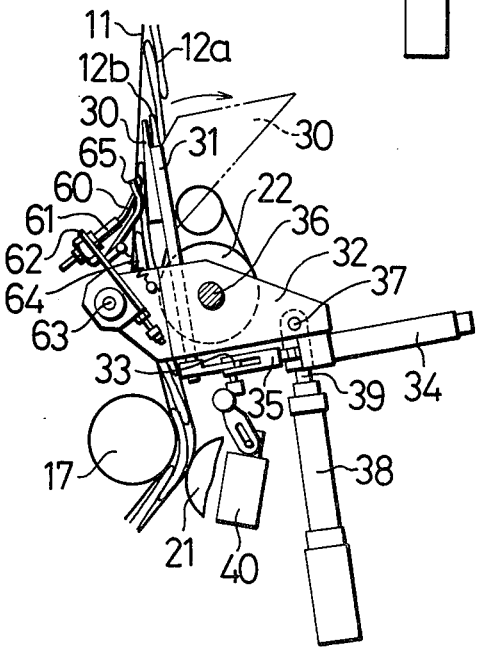

Referring to FIG. 2 and FIG. 3A, as well as to FIG. 3B, the section plate 30 has a generally triangular shape having a narrowed end, and is fixed, at its base portion, to a shaft 31 provided outside of the breadth of the path of the newspaper row. The shaft 31 rotatably passes through a bracket 32 and supported by the latter, and is provided with an arm 33 at its lower end. The arm 33 is supported at its intermediate portion by the end of a rod 35 which projects outwardly from the cylinder 34 fixed to the lower surface of the bracket 32.

Therefore, the section plate 30 is adapted to be rotated through 90°, around the shaft 31, from the position of full line to the position of two-dots-and-dash line in FIGS. 2 and 3, as a result of an extension of the rod 35 of the cylinder 34.

On the other hand, the bracket 32 is rotatably secured to the end of a shaft 36 of the roller 22. At the same time, the bracket 32 is pivoted at its portion 37 confronting said shaft 31 of the bracket itself, by the end of a rod 39 projecting out from a cylinder 38 which is fixed to a frame not shown.

Therefore, at the position of starting or returned as shown in FIG. 3A, the rod 39 of the cylinder 38 is extended to bring the section plate 30 behind the row 12 of the newspapers to prepare for the operation, while, in the operating position shown in FIG. 3B, the rod 39 is shortened to bring the section plate 30 into the row 12 of the newspapers.

A limit switch 40 fixed to a frame not shown is adapted to be switched to ON when the section plate 30 is inserted into the row 12, and to be switched to OFF when the section plate 30 is at its waiting or preparing state. A locking mechanism for locking a sampling blade (this will be detailed later) is adapted to be disengaged, when the limit switch 40 is closed.

Figure 5:
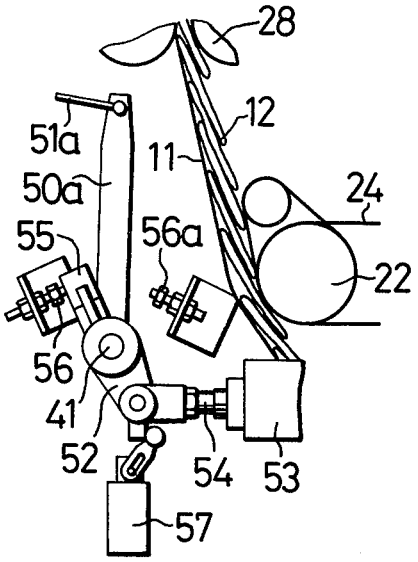
FIGS. 5A and 5B are side elevational views explaining the manner of operation of the sampling blades.
Figure 5:
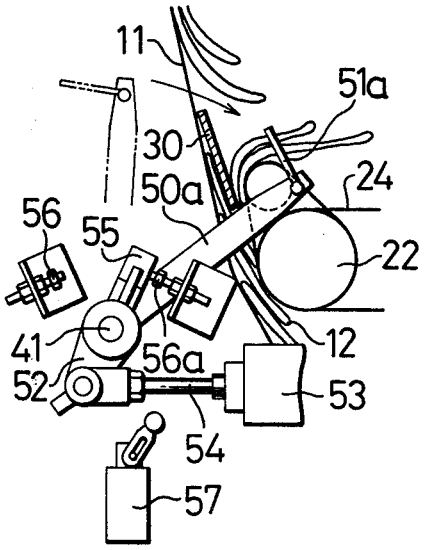
Figure 6A:
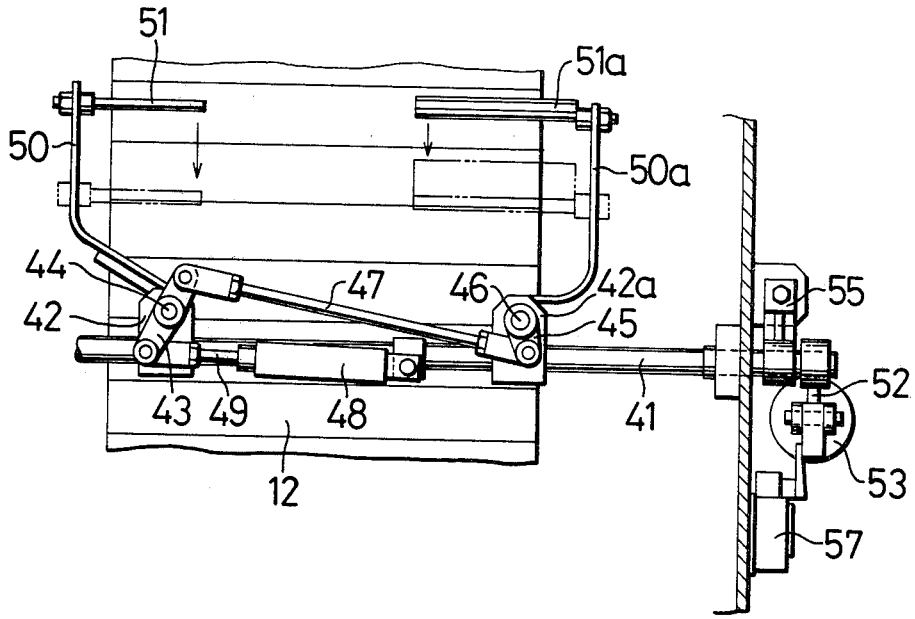
FIGS. 6A and 6B are front elevational views explaining the manner of operation of the sampling blades.
Figure 6B:
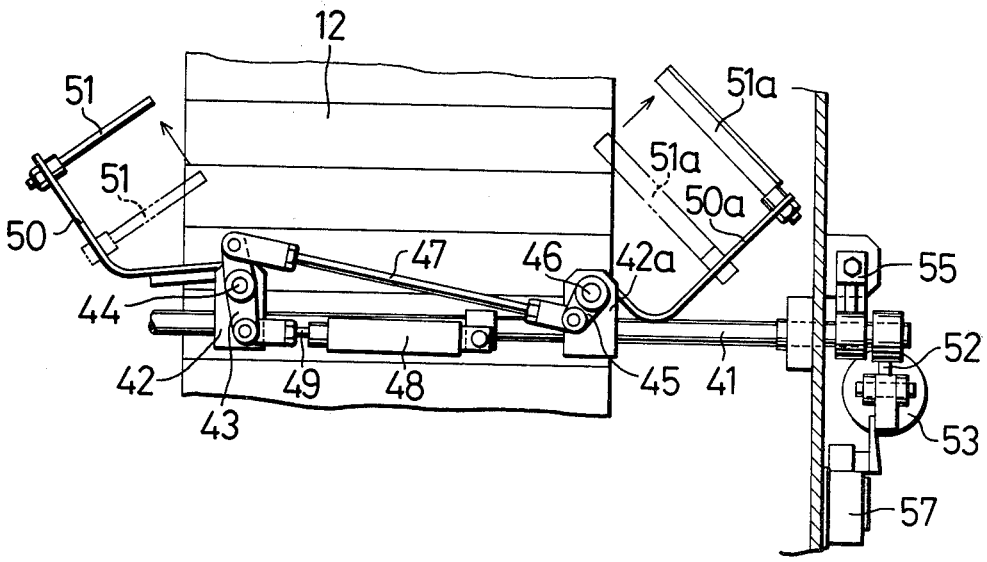

FIGS. 5A and 5B, as well as FIGS. 6A and 6B show the detailed construction of the sampling blade. Referring to these Figures, a shaft 41 is secured for free angular displacement to extend horizontally, to the rear portion of the upright carrier section. At two intermediate portions of the shaft 41, fixed are a pair of brackets 42 and **42*a*. The bracket 42 pivotably supports a straight lever 43 at an intermediate position of the latter, while the other bracket 42*a* pivotably supports the base portion of an arm 45. The free end of the arm 45 is connected to one end of the straight lever 43 by a link 47, while the other end of the straight lever 43 is connected to the end of a rod 49 projecting out from a cylinder 48 having a base portion secured to the aforementioned shaft 41**.

A left-hand side blade 51 is secured to the end of an arm 50 having a base on an intermediate portion 44 of the straight lever 43, while a right-hand side blade **51*a* is secured to the end of another arm 50*a* having a base on the base portion of the aforementioned arm 45. Consequently, as the rod 49 of the cylinder 48 is extended, both blades 51 and 51***a* are brought into the breadth of the row 12 of the newspapers, as shown in FIG. 6A, while, when the rod 49 is retracted, the blades 51 and 51*a* are brought out of the row 12 of the newspapers so as not to interfere with the latter.

The shaft 41 carries at its one end an arm 52 having one end pivotally secured to the end of a rod 54 projecting out from a cylinder 53. Therefore, the pair of blades 51 and 51*a* are retracted to positions behind the row 12 of the newspapers as the rod 54 is retracted by the cylinder 53, as will be seen from FIG. 5A, while, when the rod 54 is extended by the cylinder 53, the blades are moved into the row 12 of the newspapers and reach the other side of the latter.

The operation of the blades 51 and 51*a* must be performed at a constant high speed, so as not to cause an error even during a high speed operation of the conveyor.

Adjustable stoppers 56 and 56*a* are provided at the retracted and advanced positions of an arm 55 extending from the shaft 41, so as to adjust and manage the operation time of the blades. A limit switch 57 is provided for confirming the advancement of the blades.

Since the time required for the operation of the blades is constant irrespective of the running speed of the conveyor belt, it is difficult to ensure the insertion of the blades to the optimum positions positions of the row, if the blades are started regardless of the running speed of the conveyor belt.

More specifically, when the conveyor belt is operated at a relatively low speed, the insertion of the blades will be made earlier then expected, while, when the conveyor belt is operated at a relatively high speed, the insertion will be behind the time.

The optimum position of insertion of the blades is preferably the mid portion of the exposed portion of the last one of the newspapers to be picked out. Thus, the blades 51 and 51*a* have to aim at the mid point of the overlapping portion of the newspaper, i.e., between 20 to 23 mm as measured from the leading end of the paper when the pitch of overlapping is 42 mm as aforementioned.

Figures 7A, 7B, 7C:
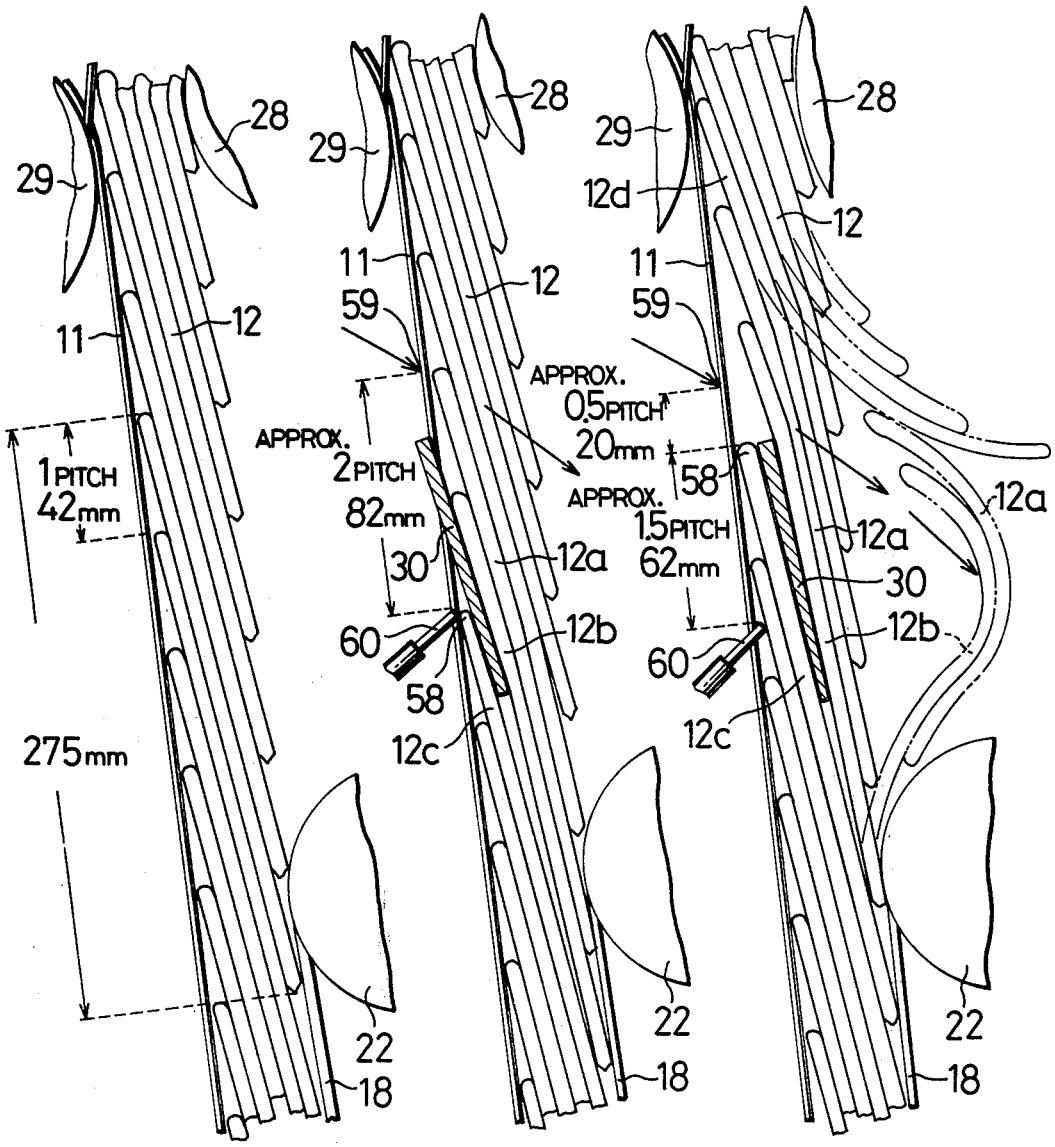
FIGS. 7A to 7C are side elevational views explaining the relationship between the detector for the earliest subsequent paper and the position of insertion of the sampling blades, in connection with the forward movement of the row of the newspapers in sequence.

The carrier upright section having a conveyor belt 11 at only one side of the row of the newspaper provides quite an unstable form of convey, so that the length of that section cannot be so large. The length is typically 6 to 7 pitches, which is almost same with the whole length 275 mm of one folded newspaper, as shown in FIG. 7A. The aforementioned section plate 30 for retaining the subsequent newspapers correctly in the row has to be inserted to this small length of the upright carrier section.

This is the reason why the optimum position of insertion of the blades is limited to such a small range as only 2 to 3 mm.

To obtain such a precise operation of the blades, according to the invention, a feeler 60 is provided to project at a position spaced downwardly from the expected position of insertion 59 by two pitches of overlapping, i.e., about 82 mm, as will be seen from FIGS. 7B and 7C. The advancement of the subsequent newspapers is confirmed by the abutment of the leading end of the earliest one of the subsequent newspapers onto this feeler 60. The order to operate the blades 51 and 51*a* is issued on the basis of this confirmation signal.

Figure 4:
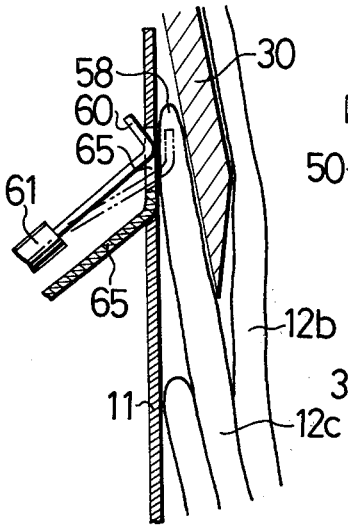
FIG. 4 is a sectional view taken along the line 4—4 of FIG. 2, for explaining the operation of a detector for detecting the earliest one of the subsequent newspapers.

The detail of a limit switch 61 (touch switch) for detecting the arrival of the leading edge of the earliest subsequent newspaper in cooperation with the contact piece 60 is shown in FIGS. 2 thru 4. The switch 61 is fixed to a base plate 62 which is pivoted to the end of the aforementioned bracket 32 by means of a pin 63. A tension spring 64 acts to exert a biasing force to force the end of the feeler 60 toward the side surface of the section plate 30. A paper guide 65 projects from the base plate 62 toward the end of the feeler 60. The feeler 60 of the switch 61 is always kept in contact with the paper guide 65 at a small contact pressure of, for example, 40 grams, so as to maintain the switch 61 in the closed condition.

As shown in FIG. 4, the switch 61 is turned to OFF, when the feeler 60 is disengaged from the paper guide 65, being pushed by the leading end 58 of the earliest subsequent newspapers.

This OFF signal is the representative of the position of the leading end 58 of the earliest subsequent newspaper 12*c* which must not follow the insertion of the blades 51 and 51*a*, and which has been conveyed to that position subsequent to the papers 12*a*,12*b* which are to be picked out for the purpose of sampling.

After the detection, as the leading end 58 of the earliest paper 12*c* has travelled a predetermined set distance which may be one and a half of the overlapping pitch, i.e., about 62 mm, as shown in FIG. 7C, the blades 51 and 51*a* are inserted into the row at an expected inserting position 59 which is a half pitch, i.e., about 20 mm, above the predetermined distance of 62 mm, thereby to force out two newspapers 12*a* and 12*b* from the row. Since the last one 12*d* of the preceding newspapers has been caught at its leading end by the pair of rollers 28, 29 provided at the upper end of the upright carrier section, it is never dropped off from the row, during the forcing out of the newspapers 12*a*, 12*b*.

Figure 9:
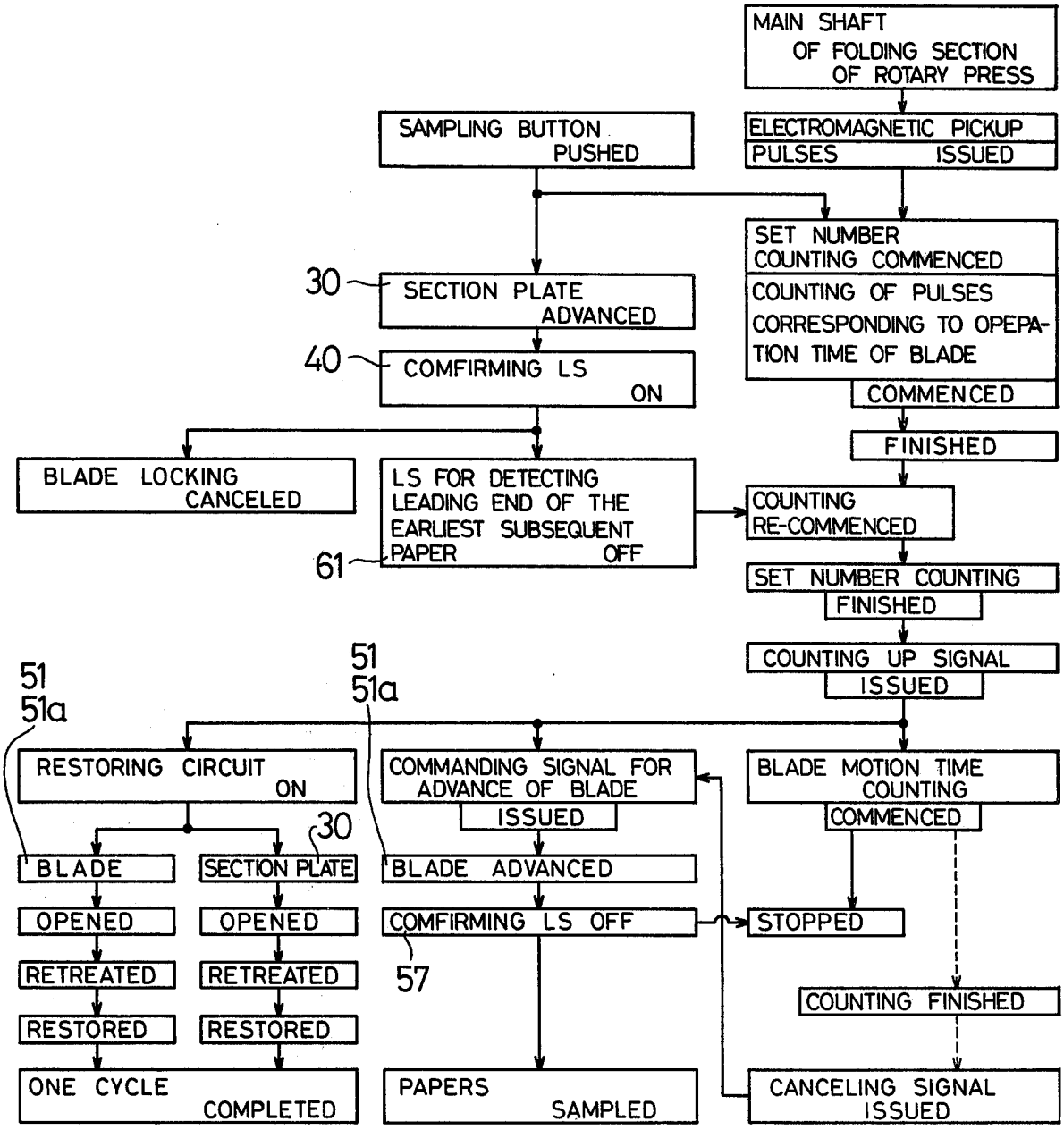
FIG. 9 is a flow chart for one cycle of operation.

As will be seen from the flow chart of FIG. 9, the time required for travelling the aforementioned predetermined set distance i.e., 62 mm, is counted by means of pulses provided in synchronization with the printing speed by an electromagnetic pickup secured to a main shaft of the folding section of the rotary press.

The signal for commencing the advance of the blade is issued, when a signal representative of completion of the pulse counting is generated, after a predetermined number of pulses have been counted, so as to initiate the advance of the blades.

In the control circuit in accordance with the invention, the signal from the electromagnetic pickup converts the distance of travel for one pitch of overlapping per paper, i.e., 42 mm, into 40 pulses. Therefore, the aforementioned predetermined set distance of 62 mm is represented by 59 pulses. The counting is commenced soon after a detecting push button switch is closed. For this counting, a counting of pulses corresponding to the operation time of the blades is previously commenced and finished.

On the other hand, the closing of the push button switch causes the section plate 30 to move ahead to turn the limit switch 40 for confirming the advancement of the section plate 30 to ON.

The counting of the remainder of the set number of 59 pulses, which has been suspended since the time of turning of the limit switch 61 for detecting the leading end of the earliest subsequent paper to off, is commenced again. As the set number of the pulses has been counted, the advancement of the blades 51 and 51*a* is commenced.

Since the operation time of the blades has been counted in advance to the restarting of the counting caused by the turning of the limit switch 40 to ON, the insertion of the blades to the point 59 is made when the leading end of the earliest subsequent paper has travelled the predetermined set distance, after the detection thereof, i.e., when the leading end has travelled the distance represented by the sum of the number of pulses corresponding to the operation time of the blades and the remainder pulses. For example, the insertion is made to the point 59 which is ½ pitch, i.e., about 20 mm, above the leading end 58 of the earliest subsequent paper 12*c*, when the leading end 58 has travelled a distance corresponding to 1½ pitch, i.e. about 62 mm, after the detection thereof.

When the pitch of overlapping of the newspapers is to be altered, the set number of pulses must be changed accordingly, in accordance with the following equation.

$$\text{Set Number of Pulses} = \frac{\text{Set Distance (62 mm)} \times \text{Pulse Number per Paper (40)}}{\text{Mean Pitch } (\times \text{ mm})}$$

Referring to FIG. 9, the counting of the operation time of the blade is commenced, when the signal representative of the completion of the set number of pulses is obtained, for the reason as follows. Namely, even when the counting completion signal is obtained, a signal for preventing the blades from being operated is generated, if the signal from the limit switch 57 for confirming the advance of the blades is not available. The count is stopped, as soon as the signal from the limit switch 57 becomes available.

The aforementioned signal representative of completion of the counting of the set number of pulses activates a circuit for the returning motion, for returning the section plate 30, as well as the blades 51,51*a*, to their starting positions.

Figure 8A:
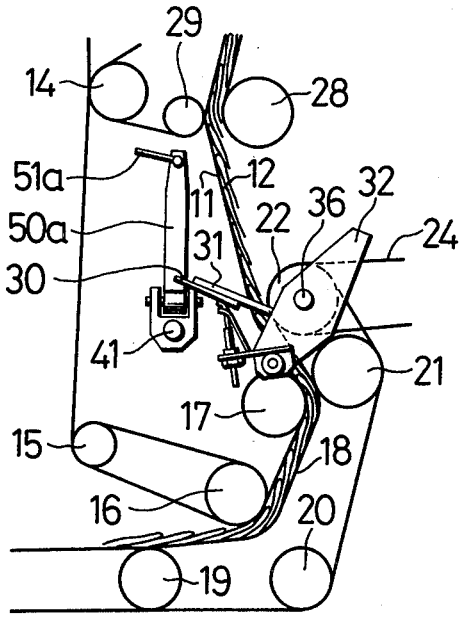
FIGS. 8A to 8D are side elevational views explaining one cycle of interlocking operation of the sampling blade and means for ensuring the stay of the subsequent newspapers in the row.
Figure 8B:
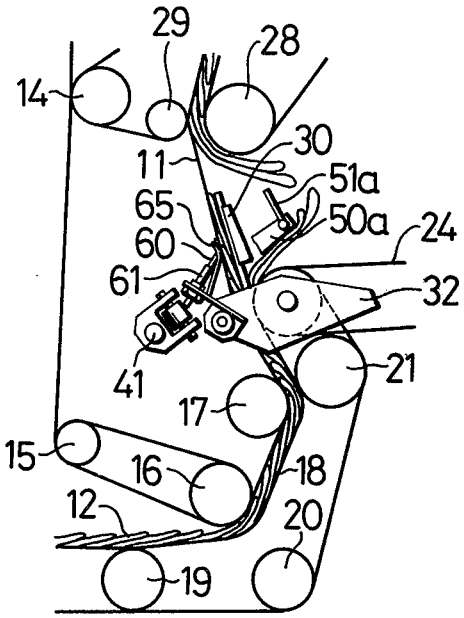

One complete cycle for the sampling is shown in sequence by FIGS. 8A to 8D. The normal state in which the sampling is not intended is shown in FIG. 8A. In this state, the section plate 30 and the blades 51,51*a* are held behind the row 12 of the newspapers, preparing for the operation. As an operator pushes the sampling button, at first the section plate 30 is moved ahead into the row 12 of the newspapers. Then, the leading end of the subsequent newspaper separated by the section plate 30 comes between the section plate 30 and the paper guide 65 to push the feeler 60 to disconnect the latter from the paper guide 65, thereby to issue the OFF signal.

The OFF signal thus generated is forwarded to the control circuit to control the starting of the blades 51 and 51*a*, so as to effect the impacting insertion of the blades 51,51*a* into the row of the newspapers, at the optimum condition, i.e., when the leading end of the subsequent newspaper has travelled the set distance. (See FIG. 8B)

Figure 8C:
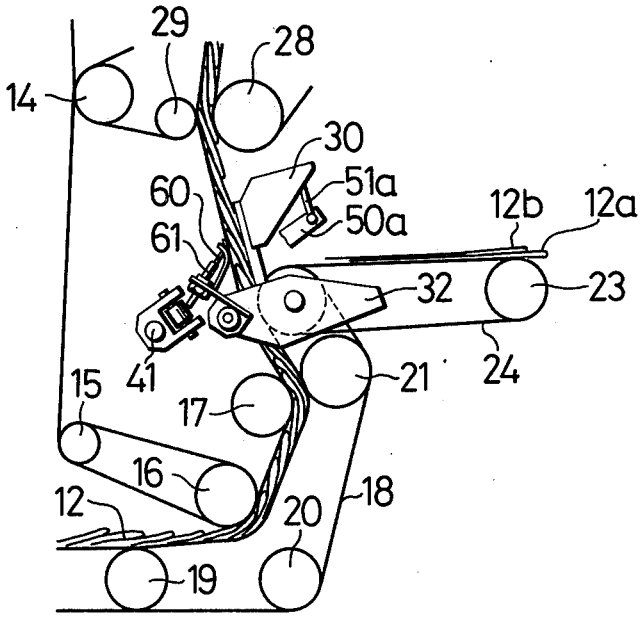
Figure 8D:
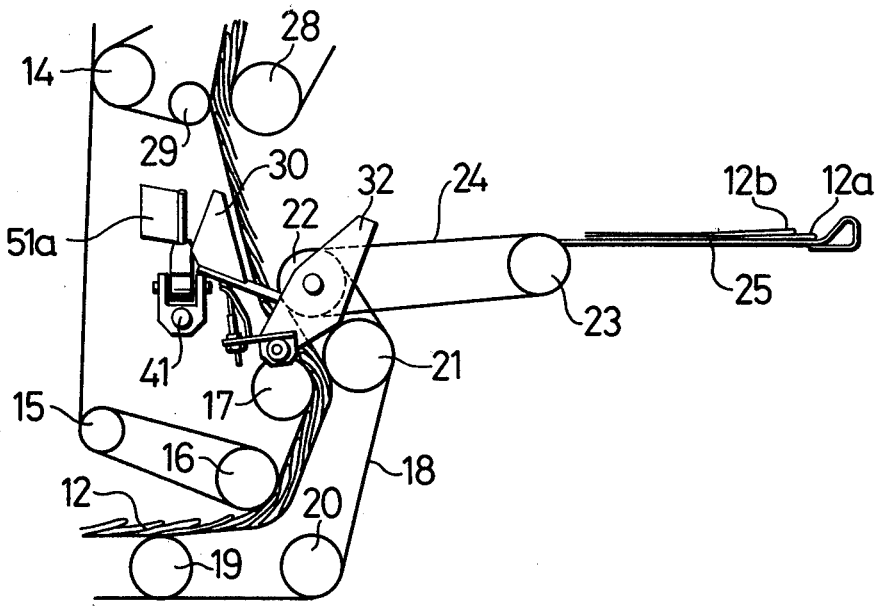

When the sampling of two sheets of newspapers is over, the section plate 30 and the blades 51,51*a* are opened to outside of the row of the newspapers, as shown in FIG. 8C, and are retracted through the outside of the row, as shown in FIG. 8D.

The section plate 30 and the blades 51,51*a* thus retracted are then returned inwardly to complete one cycle of operation, as will be seen from FIG. 8A.

Figure 11:
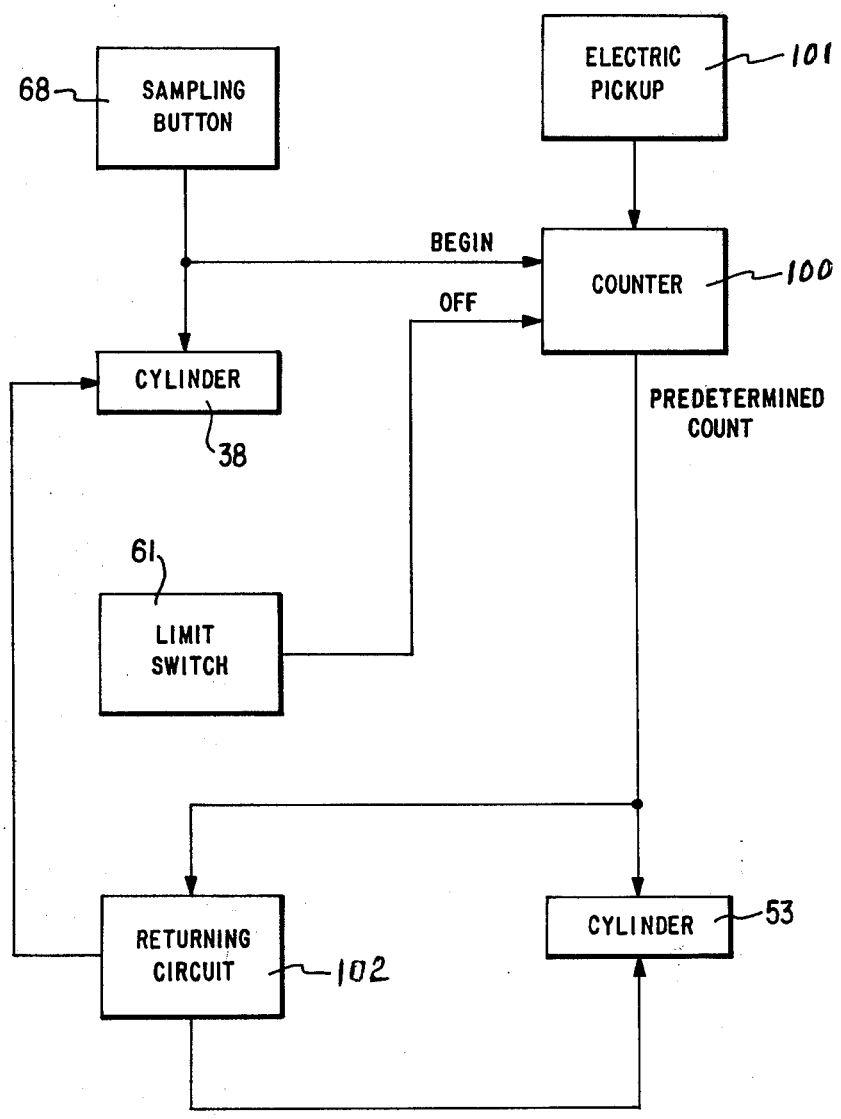
FIG. 11 is a schematic diagram of an exemplary circuit arrangement for actuating a section plate and side blades which may be used to actuate the section plate and blades.

FIG. 11 is an exemplary, simplified block diagram of a circuit for actuating the section plate 30, via cylinder 38, and the blades 51, 51*a*, via the cylinder 53.

As shown in FIG. 11, the circuit includes the sampling button 68 which has its output coupled to one controlling input to the cylinder 38. The sampling button 68 output is also fed to the start or begin input of the counter 100, which receives its stop or off input from the limit switch 61. The counter 100 receives its signal input from the electric pickup 101, which can be electromagnetic in nature.

The count output from the counter 100, which is predetermined by the begin and off signals, is coupled to one controlling input to the cylinder 53, which has its second controlling input coupled to an output from the returning circuit 102. The returning circuit 102 receives the output from the counter 100 and has its second output coupled to the second controlling input of the cylinder 38.

Waste papers which have to be ejected out of the row are often caused by the additional supplying of the papers, commencement of the printing, failure of the carrier, emergency stop of the whole apparatus due to a running out of the paper. The number of the newspapers thus wasted fluctuates between 8 and 20 sheets.

Figure 10:
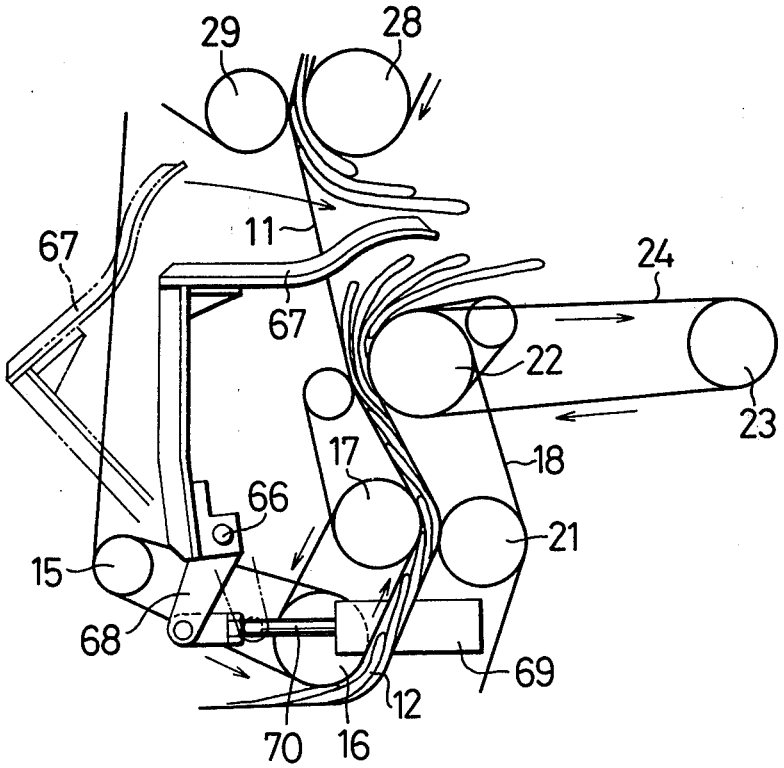
FIG. 10 is a side elevational view explaining the manner of operation of a fork for ejecting wasted papers.

Referring to FIGS. 1 and 10, a fork 67 having a base portion constituted by a horizontal shaft 66 is provided, the horizontal shaft 66 carrying an arm 68 projecting therefrom. The end of the arm 68 is pivoted to the end of a rod 70 projecting out from a cylinder 69. Thus, the fork 67 is adapted to be moved across the row of the newspaper, as the rod 70 is extended, so that the subsequent papers are interrupted by the fork 67 to be ejected onto the conveyor belt 24.

The distance between the brushing position joining papers by a paster and the point where the fork 67 is expected to work is nearly constant. As a result of count-controlling of the distance, one can correctly eject the waste papers caused by the paster.

More specifically, the electromagnet pickup secured to the main shaft of the folding section of the rotary press provides successive pulses the number of which correctly corresponding to the speed of the main shaft. Thus, the distance of travel is converted into the number of pulses. The counting of the pulses is commenced at the time of brushing and the fork is started after a predetermined number of pulses has been counted, so that the fork 67 may correct disposal of the newspapers to be wasted.

As has been described, according to the invention, an upright carrier section of an extremely limited length is provided in the conveyor line of the newspapers, so that the newspapers may be forced out of the row for the purpose of sampling by means of blades which move from one to the other side of the upright carrier section.

At the same time, means are provided for ensuring the printed newspapers 12*d* and 12*c*, at leading and trailing sides of the newspapers 12*a*,12*b* to be picked out for sampling, to stay in the row of the papers correctly, regardless of the sampling operation.

In addition, means are provided for controlling the operation of the blades to ensure the latters to be inserted into the optimum position of the row of the newspapers, irrespective of the operation speed of the conveyor, so that an accurate and reliable sampling operation is resulted.

The common use of the ejecting port for papers by the sampling apparatus and by the means for ejecting the wasted papers provides a reasonable compact construction of the whole apparatus.

What is claimed is:

1. A sampling apparatus of printed papers from a conveyor line thereof comprising:

an upright carrier section extending upwardly and provided in a conveyor line for conveying a series of folded printed papers arrayed in a row at a predetermined pitch of overlapping from a folding section of a rotary press to a subsequent processing apparatus such as a counterstacker, said upright carrier section being provided with a conveyor belt at only its one side at which the overlapping end of successive printed papers appears at the leading side as viewed in the direction in which said printed papers are moved, said upright carrier section lacking conveyor belt at the other side thereof;

means including a pair of mutually opposing rollers provided at the upper end of said upright carrier section, at least one of which being displaceable, for adjusting the number of the printed papers to be taken out for the purpose of sampling and, at the same time, for retaining the preceding printed papers correctly within the row of the successive printed papers;

means for retaining subsequent printed papers within said row having a section plate adapted to be inserted into said row of said printed papers from one side of said upright carrier section at which said conveyor belt is provided and to be returned to the starting position clearing said row after the completion of sampling;

means for taking out a predetermined number of said printed papers from said row, including at least one blade adapted to be inserted into said row of said printed papers from said one side of said upright carrier section at a position above the position at which said section plate is inserted, and to be returned to the starting position clearing said row, after the completion of said sampling; and means for controlling the operation of said blade having a feeler projected at a position spaced downwardly from the expected position of insertion of said blade, said feeler being adapted to activate a limit switch for detecting the leading end of an earliest one of the subsequent printed papers and preparing for issueing a signal representative of the detection of the advancement of the leading end of the earliest subsequent printed paper, said controlling means adapted to cause said section plate to move ahead and to commence the counting of a set number of pulses corresponding to a set distance, when a push button switch for ordering the sampling is closed, said set distance being obtained by subtracting a distance corresponding to a half pitch from the distance between the position of said feeler and the expected position of insertion of said blade, said controlling means further adapted to suspend said counting when pulses of a number corresponding to the operation time of said blade have been counted, and to start the counting of the remainder of the pulses again on the basis of said signal representative of said detection, and to issue a signal for ordering said blade to move ahead.

2. A sampling apparatus of printed papers from a conveyor line thereof comprising:

an upright carrier section extending upwardly and provided in a conveyor line for conveying a series of folded printed papers arrayed in a row at a predetermined pitch of overlapping from a folding section of a rotary press to a subsequent processing apparatus such as counterstacker, said upright carrier section being provided with a conveyor belt at only its one side at which the overlapping end of successive printed papers appears at the leading side as viewed in the direction in which said printed papers are moved, said upright carrier section lacking conveyor belt at the other side thereof;

means including a pair of mutually opposing rollers provided at the upper end of said upright carrier section, at least one of which being displaceable, for adjusting the number of the printed papers to be taken out for the purpose of sampling and, at the same time, for retaining the preceding printed papers correctly within the row of the successive printed papers;

means for retaining subsequent printed papers within said row having a section plate adapted to be inserted into said row of said printed papers from one side of said upright carrier section at which said conveyor belt is provided and to be returned to the starting position clearing said row after the completion of sampling;

means for taking out a predetermined number of said printed papers from said row, including at least one blade adapted to be inserted into said row of said printed papers from said one side of said upright carrier section at a position above the position at which said section plate is inserted, and to be returned to the starting position clearing said row, after the completion of said sampling;

means for controlling the operation of said blade having a feeler projected at a position spaced downwardly from the expected position of insertion of said blade, said feeler being adapted to activate a limit switch for detecting the leading end of an earliest one of the subsequent printed papers and preparing for issueing a signal representative of the detection of the advancement of the leading end of the earliest subsequent printed paper, said controlling means adapted to cause said section plate to move ahead and to commence the counting of a set number of pulses corresponding to a set distance, when a push button switch for ordering the sampling is closed, said set distance being obtained by subtracting a distance corresponding to a half pitch from the distance between the position of said feeler and the expected position of insertion of said blade, said controlling means further adapted to suspend said counting when pulses of a number corresponding to the operation time of said blade have been counted, and to start the counting of the remainder of the pulses again on the basis of said signal representative of said detection, and to issue a signal for ordering said blade to move ahead; and means for ejecting waste papers having a fork adapted to be inserted into said row of said printed paper from one side of said upright carrier section to interrupt said row, whereby said wasted printed papers are ejected along said fork.

3. An apparatus as claimed in claim 1, wherein said upright carrier section is slightly inclined toward one side of said section at which said conveyor belt is provided.

4. An apparatus as claimed in claim 2, wherein said upright carrier section is slightly inclined toward one side of said section at which said conveyor belt is provided.

5. An apparatus as claimed in claim 1, including an auxiliary conveyor belt mechanism provided at the other side of said upright carrier section, disposed at the lower end portion of said upright carrier section and having one end constituted by a small auxiliary roller, and auxiliary conveyor belt mechanism is adapted to be brought to an upright posture, when the thickness of said printed paper is too small to provide a self-supporting force of said printed papers, thereby to prevent said printed papers from falling down.

6. An apparatus as claimed in claim 2, including an auxiliary conveyor belt mechanism provided at the other side of said upright carrier section, disposed at the lower end portion of said upright carrier section and having one end constituted by a small auxiliary roller, said auxiliary conveyor belt mechanism is adapted to be brought to an upright posture, when the thickness of said printed paper is too small to provide a self-supporting force of said printed papers, thereby to prevent said printed papers from falling down.

* * * * *